US006089418A

United States Patent [19]

Gaiser et al.

[11] Patent Number: 6,089,418

[45] Date of Patent: Jul. 18, 2000

[54] DISPENSING CLOSURE WITH PRESSURE ACTUATED VALVE

[75] Inventors: Rick Gaiser, Spring Grove; Valentin Hierzer, Arlington Heights; Robert Simpson, Grays Lake, all of Ill.

[73] Assignee: Crown Cork & Seal Technologies Corporation, Alsip, Ill.

[21] Appl. No.: 08/880,208

[22] Filed: Jun. 23, 1997

[51] Int. Cl.[7] ..... B65D 5/72; B67D 5/06; B67B 5/00

[52] U.S. Cl. ..... 222/490; 222/494; 222/185.1; 222/153.06

[58] Field of Search ..... 222/490, 185.1, 222/153.06, 494

[56] References Cited

U.S. PATENT DOCUMENTS

| | | | |
|---|---|---|---|
| 1,989,714 | 2/1935 | Statham | 221/60 |
| 2,684,789 | 7/1954 | Marchant | 222/212 |
| 2,713,953 | 7/1955 | Jewell | 215/74 |
| 4,728,006 | 3/1988 | Drobish et al. | 222/181.3 |
| 4,749,108 | 6/1988 | Dornsbusch et al. | 222/212 |
| 5,213,236 | 5/1993 | Brown et al. | 222/490 |
| 5,271,531 | 12/1993 | Rohr et al. | 222/490 |
| 5,377,877 | 1/1995 | Brown et al. | 222/185.1 |
| 5,409,144 | 4/1995 | Brown | 222/185.1 |
| 5,456,374 | 10/1995 | Beck | 222/153.06 |
| 5,531,363 | 7/1996 | Gross et al. | 222/494 |
| 5,642,824 | 7/1997 | Hess, III et al. | 215/235 |
| 5,743,443 | 4/1998 | Hins | 222/490 |

FOREIGN PATENT DOCUMENTS

| | | |
|---|---|---|
| 0 555 623 A1 | 8/1993 | European Pat. Off. . |
| 8-282703 | 10/1996 | Japan . |

*Primary Examiner*—Andres Kashnikow
*Assistant Examiner*—Keats Quinalty
*Attorney, Agent, or Firm*—Woodcock Washburn Kurtz Mackiewicz & Norris LLP

[57] ABSTRACT

A valved dispensing closure is adapted to be mounted on a resiliently deformable bottle. The valved closure has a self-sealing dispensing valve mounted internally of the base of the closure by a securement in the form of an internally mounted retaining ring or inner deformable plug. A protective cover is adapted to extend over the side and top of the base to protect the valve from inadvertent activation. A tamper evident part is at the bottom of the base to visually indicate when the closure is removed after having been applied on the container after it is filled with product to be dispensed.

13 Claims, 4 Drawing Sheets

DISPENSING CLOSURE WITH PRESSURE ACTUATED VALVE

BACKGROUND OF THE INVENTION

Various packages have been proposed and some are presently available for storing, shipping and dispensing viscous materials such a shampoos, conditioners, soaps and other flowable products including other liquids, pastes and the like. Some of these packages include a flexible container having a dispensing closure and when inverted and squeezed, opens a self sealing dispensing valve in the closure at a predetermined threshold pressure to discharge the contents of the container. When the external forces on the container are removed, and the internal pressure in the container is reduced below the predetermined threshold pressure for dispensing, the valve closes. The valve remains closed as long as the threshold pressure is not exceeded.

Self sealing dispensing valves have been disclosed in U.S. Pat. Nos. 4,728,006; 5,271,531 and 5,531,363. Self sealing dispensing valves are also offered commercially by Liquid Molding Systems, Inc. of Midland, Mich. which has been issued U.S. Pat. Nos. 5,213,236; 5,377,877 and 5,409,144.

Furthermore, dispensing closures of the foregoing type are, in most instances, required to render the packages "shippers", in that, product will not inadvertently nor accidentally be dispensed during shipment between the time the container is filled with product to be dispensed to the ultimate purchase and use by a consumer.

SUMMARY OF THE INVENTION

A principal object of the present invention is to provide a dispensing closure utilizing a self sealing dispensing valve of the foregoing type for a package utilizing a flexible container bottle or tube that renders the ultimate package a shipper for viscous fluids.

Another object is to provide a dispensing closure of the foregoing type for a package that may be readily stored and shipped following filling without concern over inadvertent dispensing or leakage of product.

A further object is to provide a dispensing closure of the foregoing type which may be readily manipulated with only one hand to facilitate dispensing of the contained products.

Still another object is to provide a dispensing closure of the foregoing type which is inexpensive to manufacture utilizing a minimum number of parts that enables a marketer to choose between many different ornamental and aesthetic packaging designs.

A still further object is to provide a dispensing closure of the foregoing type that provides a high degree of control over the amount of product dispensed and which is self-cleaning upon the application of squeezing forces and to the flexible container, and which is self-sealing upon removal of the squeezing forces applied to the flexible container.

A dispensing package of the foregoing type includes a resiliently and flexibly deformable container such as a bottle or tube having a dispensing closure with a self sealing dispensing valve having slits and which normally is in a concave sealed position. A cover or cap forming part of the dispensing closure covers and protects the valve during storage and shipment. In use by a consumer, the cover or cap is initially removed to expose the valve. The container is then inverted and may be squeezed by applying manual forces for purposes of generating internal pressures that exceed a threshold value to effect shifting of the valve from an inwardly concave sealed position before it will dispense any product through its slits. When the threshold value is exceeded, the valve undergoes movement from the inwardly concave position, to an open, outwardly convex position. When the squeezing forces are released, the internal pressures are reduced causing the valve to return towards its inwardly concave position, to effectuate product cut-off. During this return there is a momentary inward opening of the valve enabling venting of the bottle interior to occur. The valve will quickly return to its sealed leak-proof position and the dispensing package can remain in its inverted position without fear or concern over leakage of product.

Dispensing packages of the present invention permit the use of a single hand, to dispense product in a neat fashion. In this regard, one hand can squeeze the container while the other hand or implement in this hand receives the product.

The several aforenoted objects and advantages will become apparent form the following detailed description which is to be taken in conjunction with the accompanying drawings.

DETAILED DESCRIPTION

Figure 1:
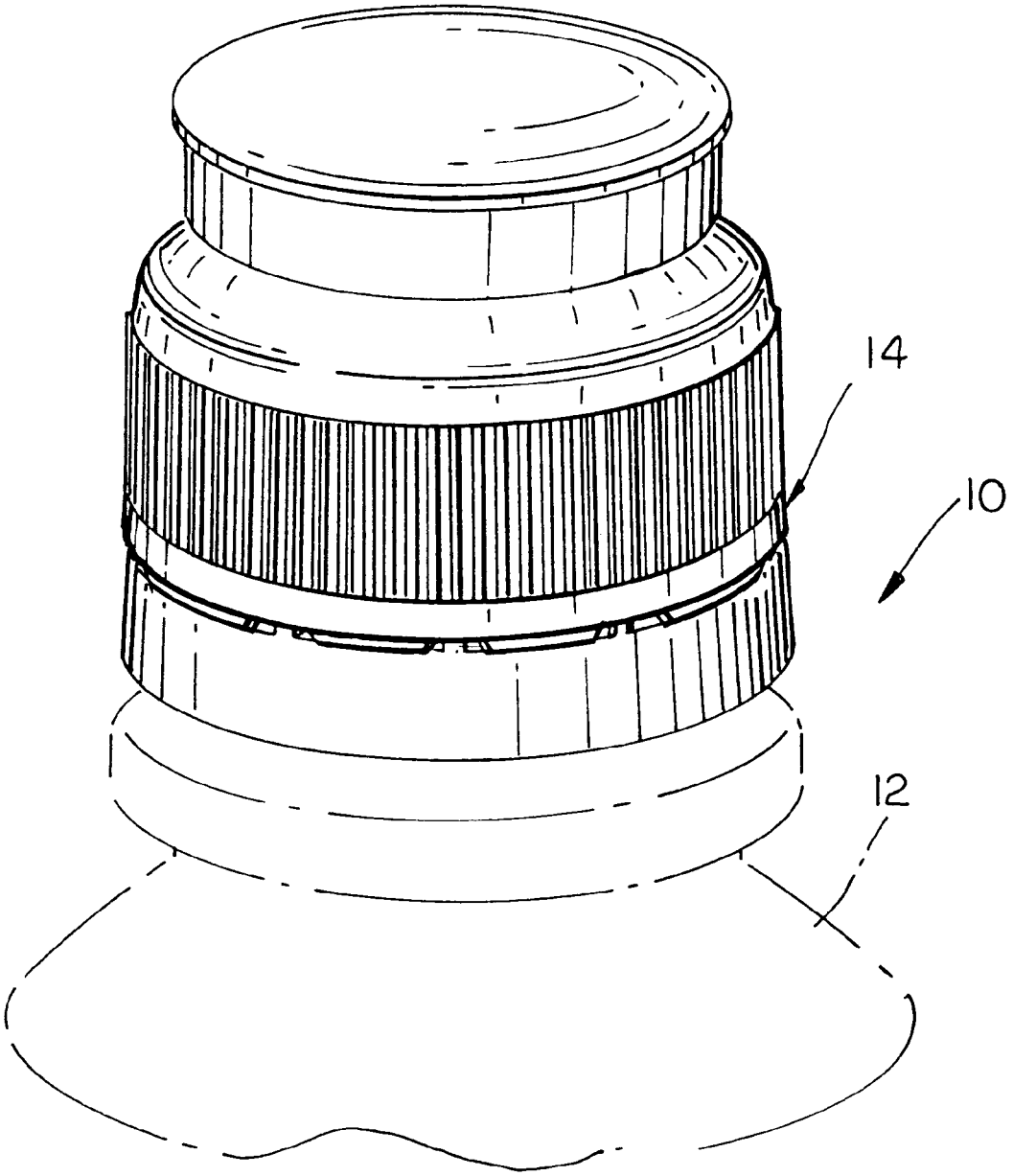
FIG. 1 is a front perspective view of a dispensing package with part of the container broken away and removed and with a dispensing closure of this invention having a self sealing dispensing valve protected by a dust cover.
Figure 2:
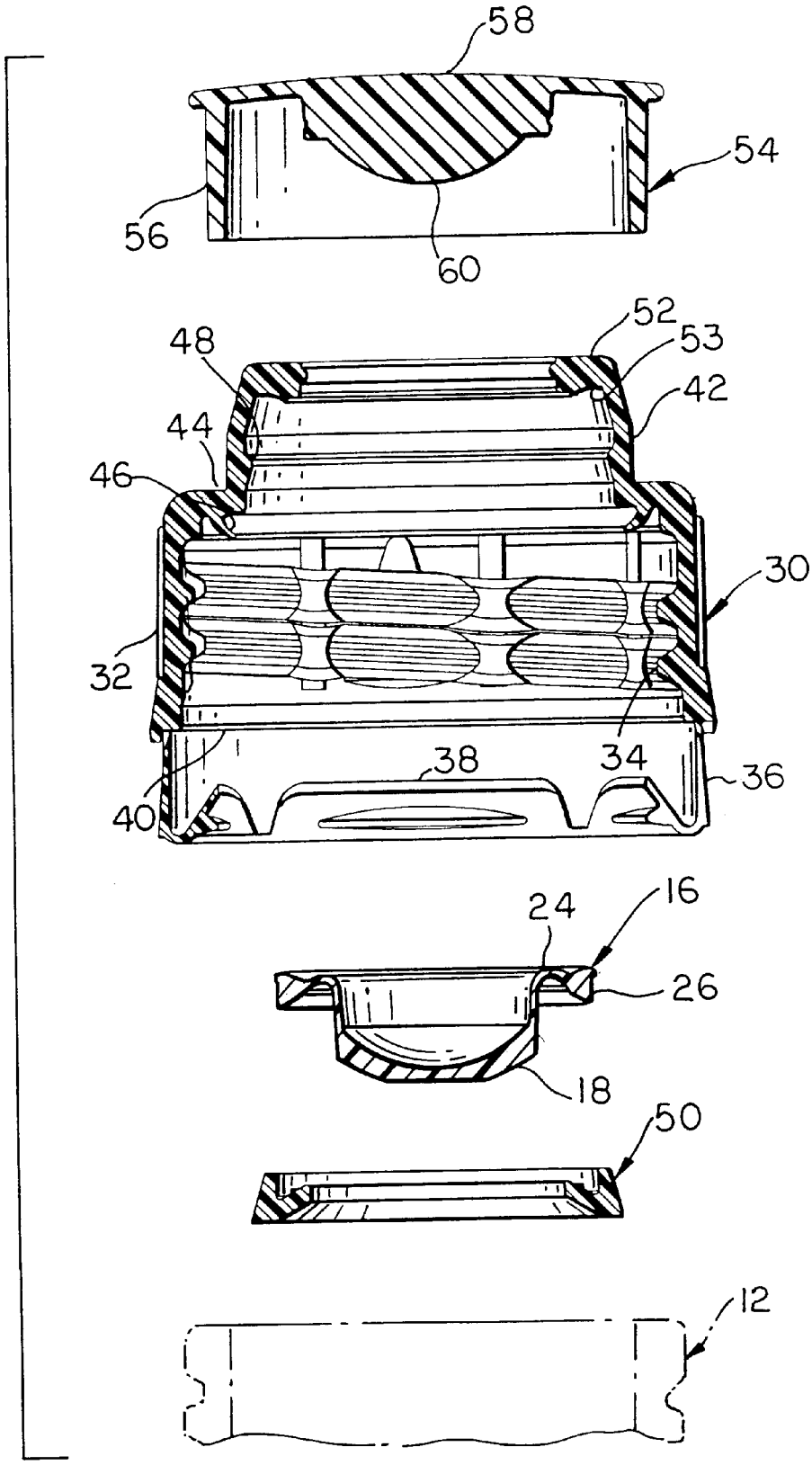
FIG. 2 is an exploded elevational view of the dispensing closure of this invention.
Figure 3:
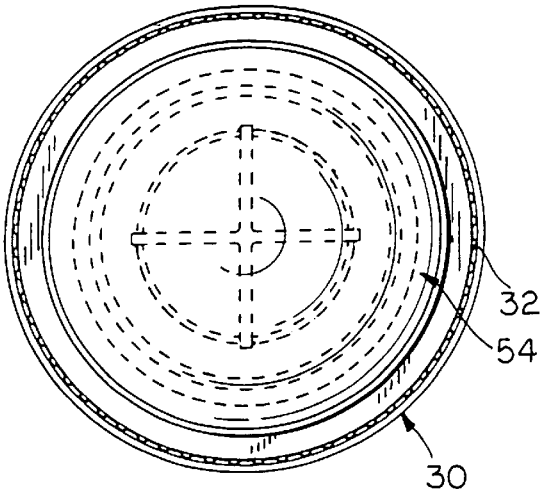
FIG. 3 is a top plan view thereof.
Figure 4:
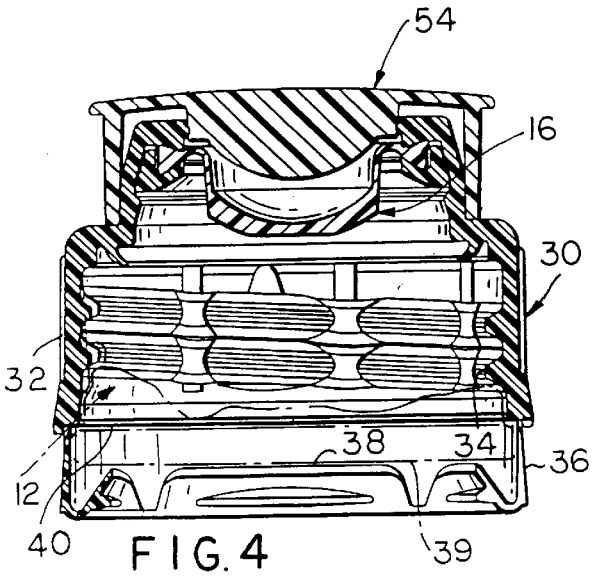
FIG. 4 is a longitudinal sectional view thereof.
Figure 5:
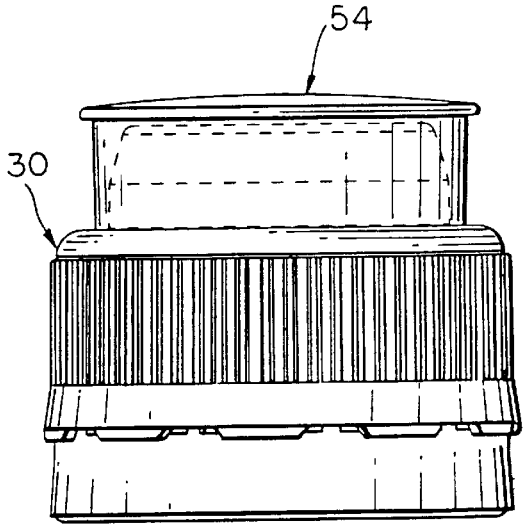
FIG. 5 is a side elevational view thereof.
Figure 6:
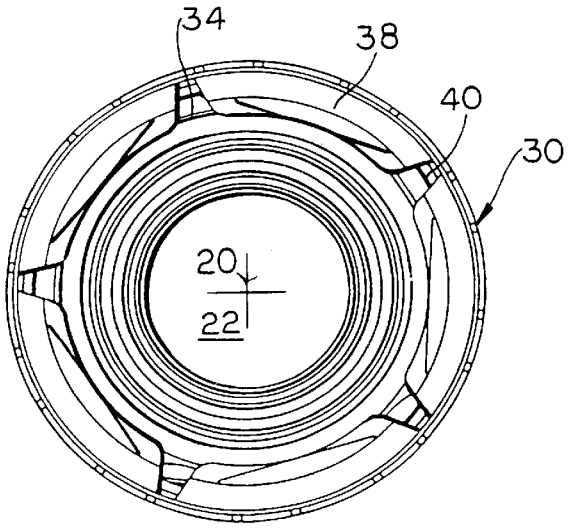
FIG. 6 is a bottom plan view thereof.

In the drawings and with specific reference to FIGS. 1–6, a dispensing package 10 is shown and is particularly adapted for dispensing fluid products, such as liquid soaps, household cleaners, polishes, moisturizing creams, foodstuffs and the like. Package 10 includes a container tube or bottle 12, and a valve dispensing closure 14.

The bottle 12 is preferably resiliently deformable and may be conveniently blow molded from one of many well known resins such as polypropylene, polyethylene, polyvinyl, polyethylene terepthalate (PET) or the like. Bottle 12 should exhibit a sufficient degree of flexibility to permit manual deformation by squeezing of the bottle side walls to extrude product through the valve dispensing closure 14. The bottle 12 should also exhibit a sufficiently strong bias or predisposition to return to its undeformed condition when external forces are removed so that a substantial instantaneous pressure drop will be generated within the bottle, thereby assisting the seal of the valved dispensing closure 14 in a manner to be described in detail.

The valved dispensing closure 14 includes a self sealing dispensing valve 16 which comprises a one-piece integrally molded member preferably constructed from liquid silicone rubber, or the like. The valve includes a concave valve head 18 with cross-slits 20 defining pie shaped flaps 22 and a discharge orifice therein. A connector sleeve 24 has one end connected with the marginal circumferentially extending flange 26, substantially triangular in section and the opposite end connected with valve head 18 adjacent to its marginal edge. Connector sleeve 24 is resiliently flexible such that when pressure within bottle 12 is raised above a predetermined threshold value, connector sleeve 24 will be caused to extend outwardly and valve head 18 to shift outwardly.

The valve head 18 has a circular plan shape, and a generally tapered thickness which is thicker at the radially outside portion of valve head 18 and thinner at the radially inside portion thereof. For further details of a self sealing dispensing valve and the functioning of its parts usable with this invention, reference is made to U.S. Pat. Nos. 5,213,236, 5,377,877 and 5,409,144 which are incorporated herein by reference.

When the valve 16 is pressurized by squeezing the sidewall of bottle 12, the connector sleeve 24 and concave valve head 18 extends outwardly, as previously explained, and the pie-shaped flaps 22 formed by cross-slits 20 open and unfold outwardly with a torqued snapping action to permit product to be dispensed therethrough. The snap type opening of valve 16 is believed to be achieved in part by the torque exerted on valve head 18 by the connector sleeve 24. Negative pressure on the interior side of the valve 16 causes a reverse flow through the cross-slits 20. Under these circumstances, the connector sleeve 24 and valve head 18 will return to its fully concave orientation with a torqued snap action. During this return action, air will be sucked back through the cross-slits 20 into the interior of bottle 12 until any vacuum therein is substantially equalized. As the pressure differential on opposite sides of the valve 16 decreases to zero, cross-slits 20 reform into their original securely sealed configuration even under the hydraulic head pressure applied thereto by the product within bottle 12 when inverted.

The valved dispensing closure 14 also includes a base 30 having a substantially cylindrical lower side wall 32 provided with internal threads 34 for mating with external threads on the neck of the bottle 12. The bottom of the side wall 32 has a downwardly depending apron 36 having an upwardly extending flanges 38 which are adapted to engage and lock under a radial rib 39 of the bottle neck when the closure 14 is initially applied to the neck of the bottle 12. The bottom of the side wall 32 is connected to the apron 36 through an interposed rupturable line of weakening 40. Thus, a tamper evident provision is advantageously provided should one attempt to remove the base 30 from the neck of the bottle 12. When this is attempted, the flanges engage the underside of the neck radial rib 39 to cause the line of weakening 40 to rupture when the base 32 is unscrewed from the bottle neck. However, when initially applying the base 30 to the neck of the bottle 12, the flanges 38 will flex to override the radial rib 39 as the closure is screwed tightly onto the threaded neck of the bottle 12.

The base 30 also includes a reduced diameter upper side wall 42 connected to the lower side wall 32 by a horizontal ledge 44. An internal circumferentially extending sealing lip 46 engages with the top of the neck of the bottle 12 to provide a seal at this juncture when the base 30 is tightly screwed on the bottle neck. The interior of the upper side wall 42 includes a radially inwardly extending lip 48 which receives and anchors in place retaining ring 50 which cooperates with the substantially horizontal radially inwardly extending top 52 to firmly clamp therebetween and secure the flange 26 of the valve 16. In this connection, the upper face of ring 50 includes a circumferentially extending recess 53 for cooperating in anchoring the valve flange 26 in place. The base top 52 has an opening 54 for exposing the valve head 18 and connector sleeve 24 and permit the discharge of product from the valve 16. A circumferentially extending recess 53 in the lower inner face of top 52 cooperates in receiving the flange 26 and anchor it in place. The provision for clamping valve flange 26 internally of the top 52 by an internally secured retaining ring 50 is an important security and anti-tamper provision of the present invention.

A protective cover 54 extends around the upper side wall 42 and over the top 52 of base 30 and valve 16. In this regard, the cover 54 includes a downwardly depending cylindrical skirt 56 which is adapted to tightly slide over and embrace the exterior of the upper side wall 42. The cover 54 includes a top 58 which is formed with a downwardly extending boss 60 which cooperates in keeping the valve head 18 in a concave sealed position and prevent it from accidentally or inadvertently extending outwardly to its discharge position.

As will be appreciated by those skilled in the art, the base 30, ring 50 and cover 54 may be molded from any one of a number of suitable resins.

When the user desires to dispense and use product from the bottle 12, the protective cover 54 is removed. The bottle 12 is inverted and the product therein may then be dispensed by squeezing the bottle side walls to cause the valve head 18 to extend outwardly and the cross slits 30 to open.

Figure 7:
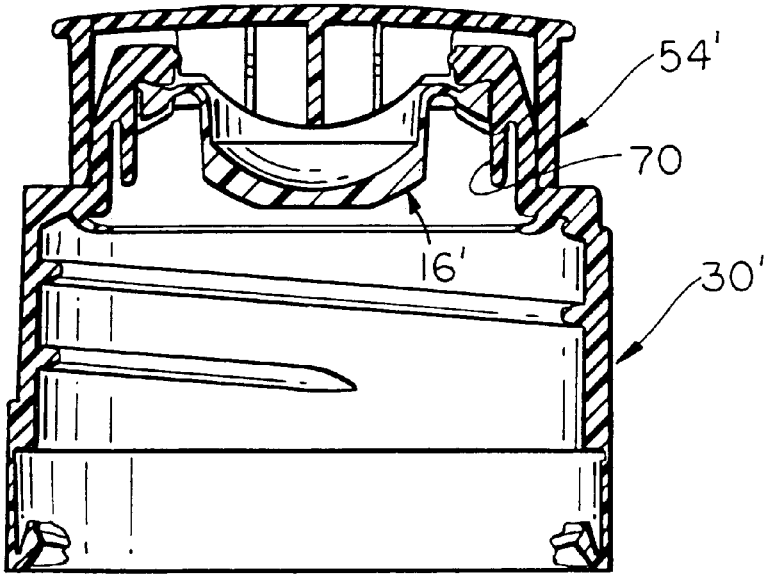
FIG. 7 is a longitudinal sectional view of another embodiment of dispensing closure prior to crimping to secure the self sealing dispensing valve.
Figure 8:
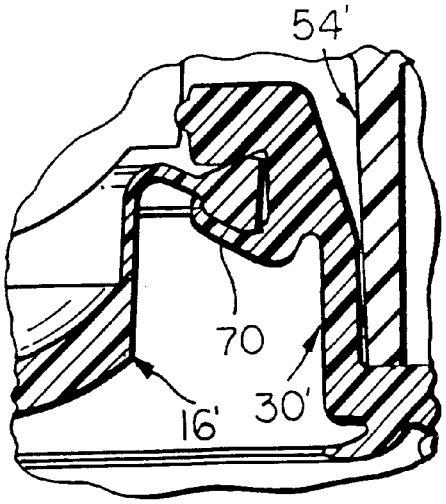
FIG. 8 is an enlarged fragmentary sectional view showing the valve crimped in place.

Reference is now made to the valved discharge closure of FIGS. 7 and 8 where like parts will be similarly numbered with an accompanying prime. In this embodiment, the retaining ring 50 is not deployed and in order to secure flange 40' under the top 52', a molded plug 70 is adapted to receive internally, this flange 40' as shown in FIG. 7, and then this plug is deformed and crimped by heat, or any other suitable technique, about the flange 40' as shown in FIG. 8 for valve retention.

Thus, the several aforenoted objects and advantages are most effectively attained. Although several somewhat preferred embodiments have been shown and described in detail herein, it should be understood that this invention is in no sense limited thereby and its scope is to be determined by that of the appended claims.

We claim:

1. A valved dispensing closure for a neck of a deformable container for containing product to be dispensed by a dispensing operation through a discharge orifice in the closure in response to manually applied lateral squeezing forces on the container and for automatically ceasing the dispensing operation when the manually applied forces are removed, the closure comprising:

a base having an interior and means for coupling with neck of the container and a substantially horizontal radially inwardly extending top having a lower inner face and an opening, a self sealing dispensing valve extending across the opening of the top and having a periphery and a central valve head having the discharge orifice which opens at a predetermined threshold pressure which is greater than a maximum hydraulic head pressure of the product in said container when the container is suspended in an inverted position with the discharge orifice facing downwardly, retaining means for retaining and sealing the periphery of the self-sealing dispensing valve on the base, said valve head having a predetermined inwardly concave configuration while the valve is in an unstressed condition when the valved closure is mounted on the neck of the container and the container is in an undeformed condition, said valve head having at least one slit defining the discharge orifice extending through its thickness from its innermost surface to its outermost surface, said valve exhibiting an ability to undergo movement from a closed, inwardly concave, sealed and leak-resistant position to an open, outwardly convex, unsealed position when said manually applied lateral squeezing forces increase the pressure inside the container beyond the threshold opening pressure of said valve to open the slit and consequently the discharge orifice, whereby product is adopted to be discharged from the container through the discharge orifice as long as the manually applied squeezing forces on the container maintain an internal pressure exceeding the threshold opening pressure of the valve, said valve also exhibiting an ability to automatically cut-off the product discharge by returning to its closed inwardly concave, sealed and leak-resistant position whenever the manually applied forces are removed from the container, the valve having a circumferentially extending flange located beneath the lower inner face of the base top, and securement means for securing the flange beneath the lower inner face of the top and within the interior of the base, the securement means including an internal radially extending lip on the interior of the base adjacent to the top and an internal retaining ring disposed within the interior of the base and having an upper face and being anchored in place by the lip and clamping the valve flange between the retaining ring and the lower inner face of the top, the lower inner face of the top and the upper face of the ring having circumferentially extending recesses for receiving the valve flange.

2. A valve dispensing closure of claim 1 wherein the valve head includes a pair of intersecting slits.

3. A valved dispensing closure of claim 1 wherein the self sealing dispensing valve includes an integral sleeve interconnecting the valve head and flange of the valve.

4. A valved dispensing closure of claim 1 wherein the base includes a lower side wall and a tamper evident means is at the bottom of the lower side wall to visually indicate when the closure is removed from the neck of the container after having been fully applied to the neck following filling of the container with product to be dispensed.

5. A valved dispensing closure of claim 1 wherein the base includes a lower side wall having internal threads for mating with external threads on the neck of the container.

6. A valved dispensing closure of claim 1 wherein the base includes a lower side wall and an upper side wall of reduced diameter and a substantially horizontal ledge interposed therebetween with an internal circumferentially extending sealing lip for sealing the base to the neck of the container.

7. A valved dispensing closure of claim 1 wherein the base includes a lower side wall and an upper side all of reduced diameter and having an exterior and a protective cover having a downwardly depending cylindrical skirt for sliding over and embracing the exterior of the upper side wall, the cover includes a top extending over the base top and over and protecting the valve.

8. A valved dispensing closure of claim 7 wherein the closure top has a downwardly extending boss that is disposed within the valve when the valve is in an unstressed position.

9. A valved dispensing closure of claim 1 wherein the valve head includes a pair of intersecting slits;

the self sealing dispensing valve includes an integral sleeve; interconnecting the valve head and flange of the valve;

the base includes a lower side wall and a tamper evident means is at the bottom of the lower side wall to visually indicate when the closure is removed from the neck of the container after having been fully applied to the neck following filling of the container with product to be dispensed;

the lower side wall having internal threads for mating with external threads on the neck of the container;

the lower side wall and an upper side wall of reduced diameter and a substantially horizontal ledge interposed therebetween with an internal circumferentially extending sealing lip for sealing the base to the neck of the container;

the base having an exterior and a protective cover having a downwardly depending cylindrical skirt for sliding over and embracing the exterior of the upper side wall, the cover includes a top extending over the base top and over and protecting the valve;

the closure top having a downwardly extending boss that is disposed within the valve when the valve is in an unstressed position.

10. A valved dispensing closure of claim 1 wherein the valve head includes a pair of intersecting slits;

the self sealing dispensing valve includes an integral sleeve interconnecting the valve head and flange of the valve;

the securement means include an internal radially extending lip on the interior of the base adjacent to the top and a retaining ring having an upper face and being anchored in place by the lip and clamping the valve flange between the retaining ring and the lower inner face of the top.

11. A valved dispensing closure of claim 1 wherein the valve head includes a pair of intersecting slits;

the self sealing dispensing valve includes an integral sleeve interconnecting the valve head and flange of the valve;

the securement means includes an internal plug on the interior of the base adjacent to the top and the plug being deformed about the valve flange to crimp the valve flange between the plug and the lower inner face of the top.

12. A valved dispensing closure for a neck of a deformable container for containing product to be dispensed by a dispensing operation through a discharge orifice in the closure in response to manually applied lateral squeezing forces on the container and for automatically ceasing the dispensing operation when the manually applied forces are removed, the closure comprising:

a base having an interior and means for coupling with neck of the container and a substantially horizontal radially inwardly extending top having a lower inner face and an opening, a self sealing dispensing valve extending across the opening of the top and having a periphery and a central valve head having the discharge orifice which opens at a predetermined threshold pressure which is greater than the a maximum hydraulic head pressure of the product in said container when the container dispensing package is suspended in an inverted position with the discharge orifice facing downwardly, retaining means for retaining and sealing the periphery of the self-sealing dispensing valve on the base, said valve head having a predetermined inwardly concave configuration while the valve is in an unstressed condition when the valved closure is mounted on the neck of the container and the container is in an undeformed condition, said valve head having at least one slit defining the discharge orifice extending through its thickness from its innermost surface to its outermost surface, said valve exhibiting an ability to undergo movement from a closed, inwardly concave, sealed and leak-resistant position to an open, outwardly convex, unsealed position when said manually applied lateral squeezing forces increase the pressure inside the container beyond the threshold opening pressure of said valve to open the slit and consequently the discharge orifice, whereby product is adopted to be discharged from the container through the discharge orifice as long as the manually applied squeezing forces on the container maintain an internal pressure exceeding the threshold opening pressure of the valve, said valve also exhibiting an ability to automatically cut-off the product discharge by returning to its closed inwardly concave, sealed and leak-resistant position whenever the manually applied forces are removed from the container bottle, the valve having a circumferentially extending flange located beneath the lower inner face of the base top, and securement means for securing the flange beneath the lower inner face of the top and within the interior of the base, the securement means including an internal plug on the interior of the base adjacent to the top and the plug being deformed about the valve flange to crimp the valve flange between the plug and the lower inner face of the top.

13. A valve dispensing closure of claim 12 wherein the lower inner face of the top having a circumferentially extending recess for receiving the valve flange.

* * * * *